US005846120A

United States Patent [19]

Barton, Jr.

[11] Patent Number: 5,846,120

[45] Date of Patent: Dec. 8, 1998

[54] TOY TOW TRAILER WITH SELF-LEVELING HITCH ASSEMBLY

[75] Inventor: William M. Barton, Jr., Encinitas, Calif.

[73] Assignee: Rokenbok Toy Company, Carfiff, Calif.

[21] Appl. No.: 797,189

[22] Filed: Feb. 11, 1997

[51] Int. Cl.[6] ..... A63H 17/05; A63H 17/267; B62D 13/00; B60D 1/00

[52] U.S. Cl. ..... 446/434; 446/427; 446/469; 280/483

[58] Field of Search ..... 280/483, 484, 280/487, 488; 446/424, 427, 428, 434, 469

[56] References Cited

U.S. PATENT DOCUMENTS

| | | | |
|---|---|---|---|
| 2,407,449 | 9/1946 | Ramsay | 280/484 |
| 2,506,718 | 5/1950 | Grant | 280/483 |
| 2,940,776 | 6/1960 | Curtis | 280/483 |
| 3,400,488 | 9/1968 | Phillpott et al. | 469/244 |
| 3,482,046 | 12/1969 | Hughson et al. | 179/154 |
| 3,639,755 | 2/1972 | Wrege | 246/187 B |
| 3,675,366 | 7/1972 | Tomiyama | 446/434 |
| 3,782,031 | 1/1974 | Byron | 46/244 R |
| 3,796,444 | 3/1974 | Hixon | 280/483 |
| 3,926,434 | 12/1975 | Cannon, Jr. | 373/86 B |
| 4,080,602 | 3/1978 | Hattori et al. | 343/225 |
| 4,087,799 | 5/1978 | Brouwer | 340/237.5 |
| 4,135,181 | 1/1979 | Bogacki et al. | 340/310 A |
| 4,171,468 | 10/1979 | Reiner | 179/15 AW |
| 4,334,221 | 6/1982 | Rosenhagen et al. | 340/825.72 |
| 4,817,948 | 4/1989 | Simonelli | 273/86 B |
| 5,073,750 | 12/1991 | Coron | 318/58.7 |
| 5,098,110 | 3/1992 | Yang | 273/438 |
| 5,148,159 | 9/1992 | Clark et al. | 340/825.22 |
| 5,364,108 | 11/1994 | Esnouf | 273/430 |
| 5,452,901 | 9/1995 | Nakada et al. | 273/310 |
| 5,471,668 | 11/1995 | Soenen et al. | 455/352 |

FOREIGN PATENT DOCUMENTS

| | | | |
|---|---|---|---|
| 241585 | 8/1984 | France | 446/427 |
| 2035932 | 7/1970 | Germany | 446/434 |
| 1430011 | 3/1976 | United Kingdom | 280/483 |

*Primary Examiner*—Robert A. Hafer
*Assistant Examiner*—Laura Fossum
*Attorney, Agent, or Firm*—Ellsworth R. Roston; Fulwider Patton Lee & Utecht, LLP

[57] ABSTRACT

A toy trailer for towing or hauling transportable elements including a unique tow hitch assembly and suitable for use with remotely-controllable motorized toy vehicles having a highly-maneuverable skid steering systems driven by single or dual motors, having a separately motorized loading device pivotally secured to the chassis of the vehicle operative to load, push or pull transportable elements or load same on to the trailer, the motorized vehicle having in one embodiment a hopper mounted on the vehicle, and having an automatic tow hitch mechanism with both the hopper and the hitching mechanism coupled to a motorized loading device gear train which mechanism provides for the sequential actuation of, first, the scoop for loading transportable elements into the hopper or on to the trailer and, second, for actuation of both the hopper for dumping and the hitch mechanism for hitching and unhitching of trailer vehicles, and including control means responsive, without wires connected to the vehicle, to operator control inputs at a remote central control station. The mechanisms and gear trains have proper ratios and dimensions preventing interference between the scoop and the hopper during forward and reverse actuation. The remote central control station being capable of controlling a plurality of vehicles with control inputs from a plurality of operators with each of the individual ones of the plurality of vehicles being compatible with the trailer.

24 Claims, 9 Drawing Sheets

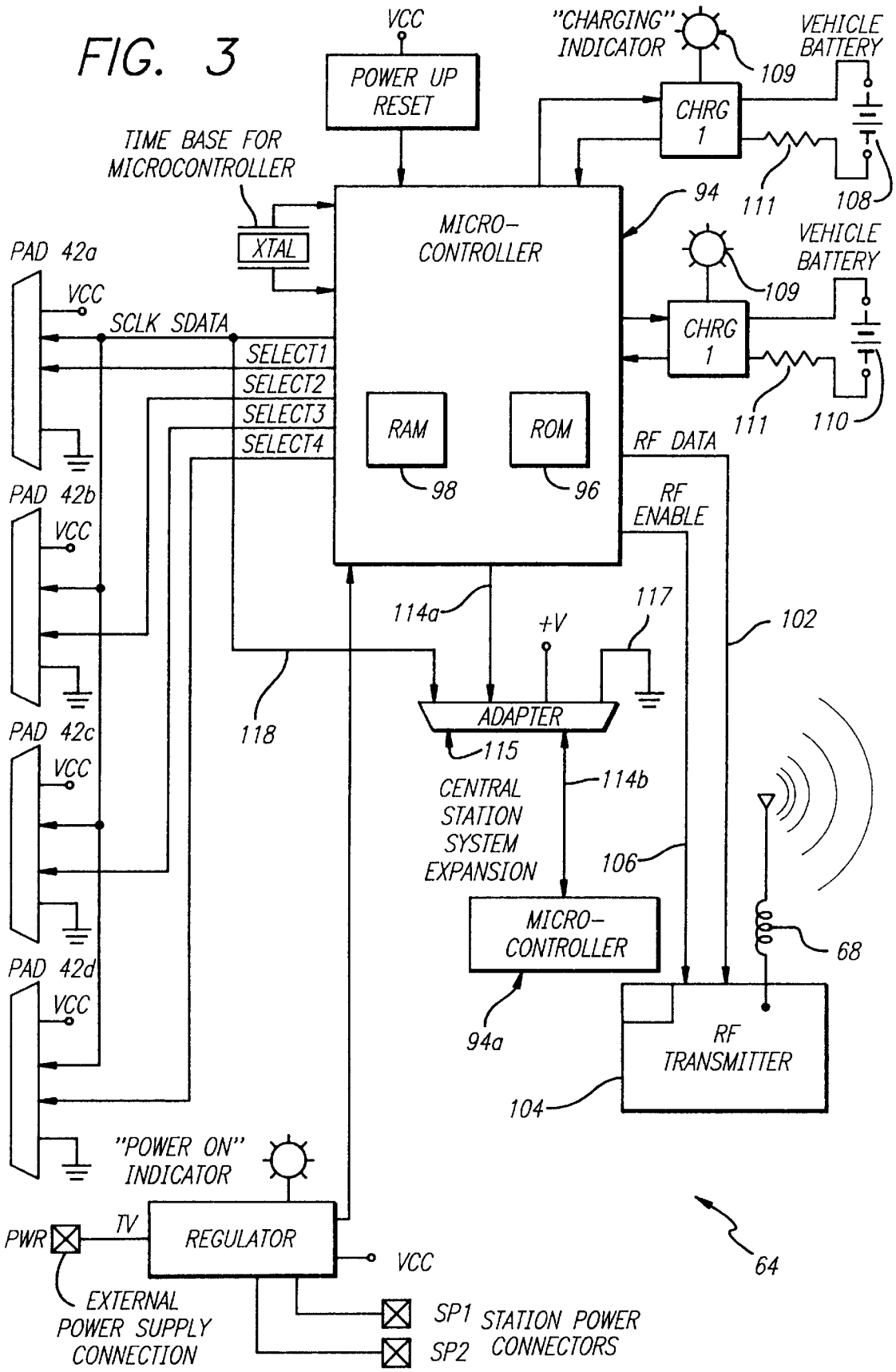
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
PAD 42a
VCC
SCLK SDATA
SELECT1
SELECT2
SELECT3
SELECT4
RAM
ROM
98
96
RF DATA
RF ENABLE
110
PAD 42b
PAD 42c
PAD 42d
114a
+V
117
102
118
ADAPTER
115
114b
CENTRAL STATION SYSTEM EXPANSION
106
68
94a
RF TRANSMITTER
104
"POWER ON" INDICATOR
PWR
TV
REGULATOR
EXTERNAL POWER SUPPLY CONNECTION
SP1
SP2
STATION POWER CONNECTORS
64

VCC
POWER UP RESET
VCC
122
12
134
TIME BASE FOR MICROCONTROLLER
XTAL
MICRO-CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

TOY TOW TRAILER WITH SELF-LEVELING HITCH ASSEMBLY

BACKGROUND OF THE INVENTION

1. Field of the Invention

This invention relates to a system for pleasurable use by people of all ages with youthful minds in operating remotely controlled vehicles simultaneously in a somewhat confined area. In the system of this invention, the vehicles can be remotely controlled to perform competitive or cooperative tasks. The system includes control pads for operation by the users, vehicles remotely controlled in accordance with the operation of the control pads and a central control station for coordinating the operation of the control pads and the vehicles. In addition to the inventive aspects of the system, each of the control pads, the central control station and the vehicles includes features of an inventive nature. The system of this invention also includes stationary plants (e.g. power plants and elevators) which are controlled by the operation of the control pads. The invention additionally relates to methods including methods for controlling the operation of the vehicles on a remotely controlled basis.

More specifically, this invention relates to remotely controlled vehicles having inventive features such as toy self-loading dump trucks, trailers, forklifts and bulldozers that can be operated to mimic the operation of similar full-size vehicles by employing highly-maneuverable skid steering, having automatic tow hitch actuation mechanisms and having motorized accessories for scooping up transportable elements, transferring the transportable elements to a hopper, automatically activating the hopper to dump the transportable elements, for gripping, lifting and translating transportable elements, and for pushing transportable elements along a surface.

2. Description of the Related Art

Various types of toy systems exist, and have existed for some time, in which vehicles are moved on a remotely controlled basis. Examples of a vehicle in such a system are an automobile, airplane, truck, water vehicle or construction vehicle. In most such systems, however, the functions and activities that the vehicle is capable of are limited to merely maneuvering a vehicle about on the ground, in the air or in the water. Other types of toy systems involve the use of blocks for building structures. These blocks often include structure for providing an interlocking relationship between abutting blocks. In this way, elaborate structures can be created by users with creative minds. However, such structures are generally built by hand manipulation of the blocks or hand manipulation of a mechanism of toy vehicle for handling the blocks.

Experience has proven that there is a desirability, and even a need, for play systems in which vehicles are remotely operated to perform functions other than merely being steered or maneuvered through a path of travel. For example, there exists a desire for a play system in which the remotely controlled vehicles have the capability of transporting elements such as building blocks maneuverable into position to build a toy or other structure. It is desirable that such systems employ a plurality of vehicles remotely controlled by switches in hand-held control pads so that users can compete against one another in performing various tasks such as moving building blocks or marbles.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit or pad providing a control of a different function in the individual one of the remotely controlled vehicles. Each of the remotely controlled vehicles in the system disclosed an claimed in application Ser. No. 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the control operations in such vehicle. Thereafter the switches identifying in such pad the control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signal and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

Co-pending application Ser. No. 08/763,678 filed by William M. Barton, Jr., Peter C. DeAngelis and Paul Eichen on Dec. 11, 1996 for a "System For And Method Of Selectively Providing The Operation Of Toy Vehicles" and assigned of record to the assignee of record of this application discloses and claims a system wherein a key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad of the system disclosed and claimed in application Ser. No. 08/763,678 fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The vehicle becomes de-activated and not illuminated. The key can thereafter be actuated to operate the vehicle to the inactive but powered state.

Co-pending application Ser. No. 08/696,263, filed by Peter C. DeAngelis on Aug. 13, 1996 for a "System And Method Of Controlling The Operation Of Toys" and assigned of record to the assignee of record of this application discloses and claims a system wherein individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address.

Each pad of the system disclosed and claimed in application Ser. No. 08/696,263 sends the modulated carrier signals to the vehicles in a pseudo random pattern, different for each pad, with respect to time. Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle. Each vehicle is controlled by an individual one of the pads for the time period that such pad sends control signals to such vehicle within a particular period of time from the last transmission of such control signals to such vehicle. Thereafter such vehicle can be selected by such pad or by another pad.

What has been needed, and heretofore unavailable, is a toy system including vehicles remotely operated to accomplish tasks such as lifting, scooping, dumping, leveling, pushing and hauling suitably sized materials and towing of trailers carrying such material, or other vehicles, in combination to create a miniature community or industrial environment, thus providing a person having a youthful mind with the opportunity to employ a remotely-controlled system of vehicles and mechanisms to accomplish these tasks and others within a reduced-scale, industrial environment in cooperation or competition with other individuals in a pleasurable manner.

SUMMARY OF THE INVENTION

The toy vehicle disclosed herein comprises a wheeled, highly-maneuverable, easily hitched to and unhitched from trailer having the capability to be releasably towed by other vehicles and being compatible with a sophisticated remote-control system. The inventive features of the trailer provide an automatic and continuous trailer hitch leveling system which maintains a position above and level to the ground when unhitched from the tow vehicle. Further, the automatic hitch assembly resists upward or downward movement while a tow vehicle backs up to and attempts to engage the well-positioned trailer hitch. Although resistant to undesirable displacement during the hitching process, the hitch assembly nevertheless easily follows the path of the tow vehicle providing for a wide range of movement during towing without lifting or otherwise impeding the progress of the tow vehicle while transitioning steep inclines or declines and tight corners.

The toy trailer vehicle is for use as part of a toy system for use by people of all ages with youthful minds. The system provides for a simultaneous control by each player of an individual one of a plurality of remotely controlled vehicles, including the trailer vehicle. This control is provided by the operation by each such player of switches in a hand-held unit or control pad, the operation of each switch in such hand-held unit providing a control of a different function in the individual one of the remotely controlled vehicles.

Each of the remotely controlled vehicles in the system of this invention can be operated in a competitive relationship with others of the remotely controlled vehicles or in a cooperative relationship with others of the remotely controlled vehicles. The vehicles can be constructed to pick up and transport elements such as blocks or marbles or other transportable elements and to deposit such elements at displaced positions.

When manually closed in one embodiment of the invention, switches in control pads control the selection of toy vehicles and the operation of motors for moving the vehicles forwardly, rearwardly to the left and to the right and moving upwardly and downwardly (and rightwardly and leftwardly) a receptacle for holding, lifting and transporting transportable elements (e.g. marbles).

When sequentially and cyclically interrogated by a central control station, each control pad sends through wires to the station signals indicating the switch closures in such control pad. Such station produces first binary signals addressing the vehicle selected by such control pad and second binary signals identifying the motor control operations in such vehicle. Thereafter the switches identifying in such control pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a control pad for a particular period of time, the vehicle selected by such control pad becomes available for selection by another control pad and such control pad can select that vehicle or another vehicle.

A cable may couple two (2) central control stations (one as a master and the other as a slave) to increase the number of control pads controlling by the vehicles. Stationary accessories (e.g. elevator) connected by wires to the central control station become operative when selected by the control pads.

BRIEF DESCRIPTION OF THE DRAWINGS

In the drawings, where like reference numerals indicate like or similar components, elements and features across the several figures:

FIG. 3 is a schematic diagram, primarily in block form, of the different features included in a central control station included in the system shown in FIG. 1;

DETAILED DESCRIPTION OF THE PREFERRED EMBODIMENT

The drawings will now be described in more detail, wherein like referenced numerals refer to like or corresponding elements among the several drawings. Moreover, reference may be made to United States patent applications Ser. No. 08/580,753, Ser. No. 08/763,678 and Ser. No. 08/696,263, which are hereby incorporated in their entirety.

Figure 1:
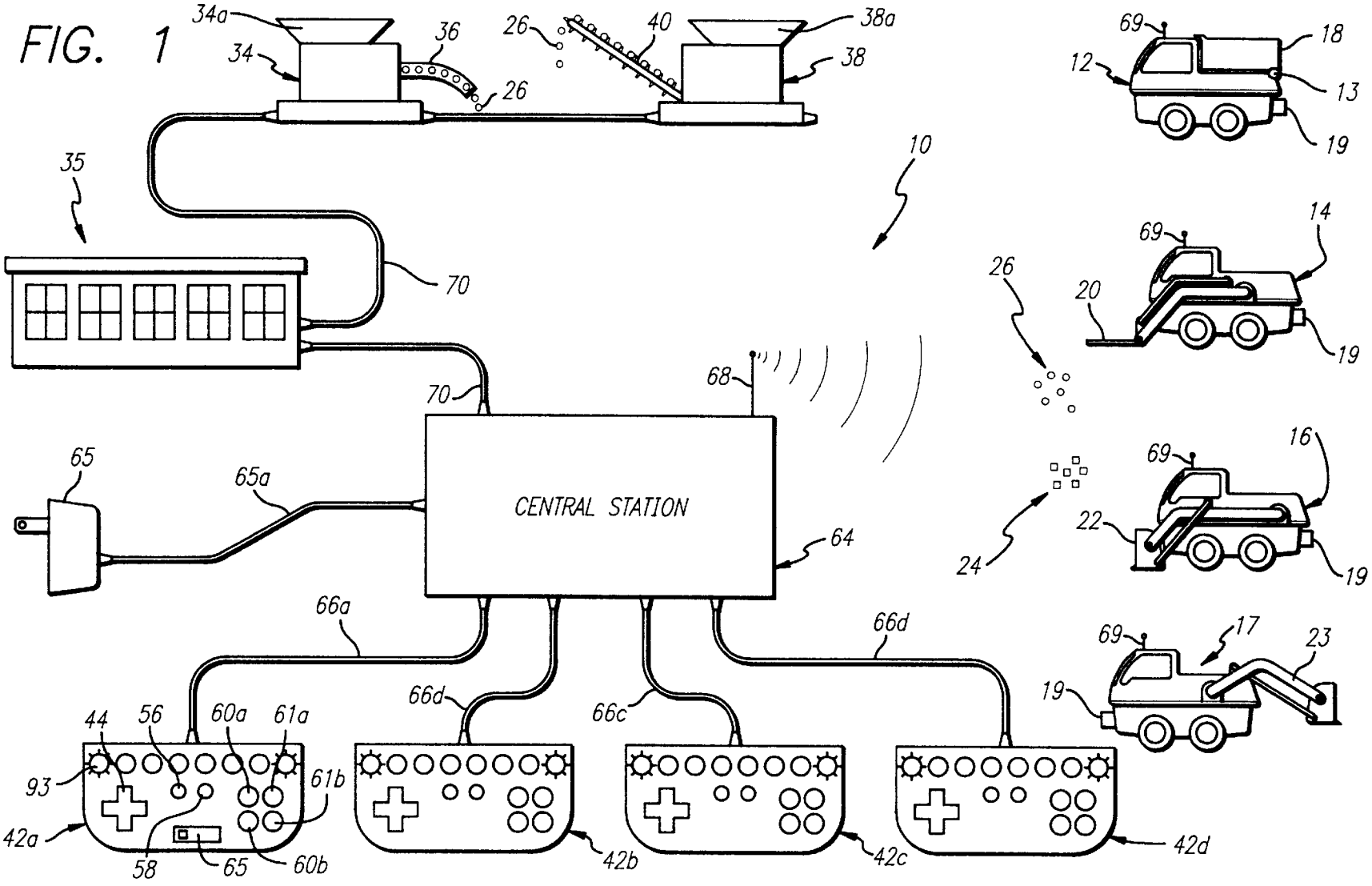
FIG. 1 is a schematic diagram of a system constituting one embodiment of the remote-control system invention.

In one embodiment of the invention, a system generally indicated at 10 in FIG. 1 is provided for controlling the selection and operation of a plurality of toy vehicles. Illustrative examples of toy vehicles constitute a dump truck, generally indicated at 12, a fork lift, generally indicated at 14, a skip loader, generally indicated at 16, another form of skip loader, generally indicated at 17 and a type of towable trailer, generally indicated at 300 (FIG. 5A). The toy vehicles such as the dump truck vehicle 12, the fork lift 14, the skip loaders 16 and 17 and the trailer 300 are simplified small scale replicas of corresponding full-size commercial units. For example, the dump truck vehicle 12 may include a working or transport member such as a pivotable tip up bin or container 18; the fork lift 14 may include a working or transport member such as a pivotable platform 20; the skip loader 16 may include a working or transport member such as a pivotable bucket 22 disposed at the front end of the skip loader; the skip loader 17 may include a working or transport member such as a pivotable bin or container 23 disposed at the rear end of the skip loader; and the trailer may include a flat bed for hauling transportable items, materials or other vehicles. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the toy vehicles 12, 14, 16 and 17 may also have a trailer hitch 19 mounted on the front or rear of the vehicle for hooking a hitch member of another vehicle, such as trailer 300 to the hitch 19 of the vehicles 12, 14, 16 and 17. The trailer hitch 19 may be remotely controlled in similar fashion to the working or transport member of the toy vehicle. Alternatively, the trailer hitch may be mechanically interconnected with the working or transport member such that remote control of the working or transport member also controls the trailer hitch 19.

Each of the dump truck 12, the fork lift 14 and the skip loaders 16 and 17 may include a plurality of motors. For example, the dump truck 12 includes a pair of reversible motors 28 and 30 (FIG. 4) to move the dump truck vehicle forwardly or rearwardly and to pivot the vehicle to the right or to the left. The motor 28 drives the movement of the front and rear wheels on the left side of the dump truck 12, and the motor 30 drives the front and rear wheels on the right side of the dump truck 12.

When the motors 28 and 30 are simultaneously operated in one direction, the dump truck 12 moves forwardly. The dump truck 12 moves rearwardly when the motors 28 and 30 are moved in the opposite direction. The dump truck 12 turns toward the right when the motor 30 is operated without simultaneous operation of the motor 28. The dump truck 12 turns toward the right when the motor 28 is operated without a simultaneous operation of the motor 30.

The dump truck 12 spins to the right when the motor 30 operates to move the vehicle forwardly at the same time that the motor 28 operates to move the vehicle rearwardly. The dump truck 12 spins to the left when the motors 28, 30 are operated in directions opposite to the operations of the motors in spinning the vehicle to the right.

Another reversible motor 32 in the dump truck 12 operates in one direction to pivot the bin 18 about its rearward hinge 13 upwardly and in the other direction to pivot the bin downwardly. In another embodiment, continued rotation of the motor 32 to pivot the bin 18 in an upwardly direction may cause the trailer hitch 19 to open. When the motor 32 is operated in the other direction, the trailer hitch 19 closes and the bin 18 pivots downwardly. An additional motor 33 may operated in one direction to turn the bin 18 to the left and in the other direction to turn the bin 18 to the right.

The construction of the motors 28, 30, 32 and 33 and the disposition of the motors and controls in the dump truck 12 to operate the dump truck are considered to be well known in the art. The fork lift 14 and the skip loaders 16 and 17 may include motors to those described above for the dump truck 12.

The system 10 may also include remotely-controlled, motorized stationary plants or accessories. For example, it may include a remotely-controlled motorized pumping station, generally indicated at 34 (FIG. 1), and driven by a pumping motor responsive to a control (not shown), for pumping elements such as the marbles 26 from a hopper 34*a* through a conduit 36. The system may also include a remotely-controlled motorized conveyor, generally indicated at 38, and driven by a conveyor motor responsive to a control (not shown), for moving the elements such as the marbles 26 from a hopper 38*a* upwardly on a ramp 40. When the marbles 26 reach the top of the ramp 40, the elements such as the marbles 26 may fall into the bin 18 in the dump truck vehicle 12 or into the bin 22 in the skip loader 16 or 17. For the purposes of this application, the construction of the pumping station 34 and the conveyor 38 may be considered to be within the purview of a person of ordinary skill in the art. Accessories or stationary plants 34 and 38 may be connected to the central station 64 either directly or through a junction box such as miniature building 35 as shown in FIG. 1.

The system 10 may also include a plurality of hand held control pads, to generally indicated at 42*a,* 42*b,* 42*c* and 42*d* (FIG. 1). Each of such control pads may have a substantially identical construction. Each of the control pads may include a plurality of actuatable buttons. For example, each of the control pads may include 4-way cruciform buttons 44 configured with four wings disposed over respective control buttons 44 arranged to drive individual ones of a plurality of switches 46, 48, 50, and 52 (FIG. 2).

One wing of the button 44 may be depressed to engage the button associated with the switch 46 to close the circuit in one direction through the motor 28 (FIG. 4) moving the selected one of the vehicle 12 forwardly. Similarly, the opposite wing of button 44 may be depressed, to close the switch 48 to close the circuit in the opposite direction through motor 28 (FIG. 4) moving the vehicle 12 rearwardly. The selective depression of the left and right segments of the button 44 closes the respective switches 52 and 50, in turn, respectively closing the circuit in one direction then the opposite direction through the respective motors 28 and 30 respectively turning the selected vehicle 12 toward the left and the right about its vertical axis.

It will be appreciated that the buttons 44 may be tilted in one diagonal direction or the other by simultaneously pressing two neighboring wings of buttons 44 to simultaneously close respective neighboring pairs of switches 46 (forward) & 50 (right) to obtain a simultaneous movement of the vehicle 12 forwardly and to the right. However, a simultaneous actuation of the top and bottom wings of the button 44 will not have any effect since such actuations represent contradictory commands. This is also true of a simultaneous actuation of the left and right wings of the button 44.

Figure 2:
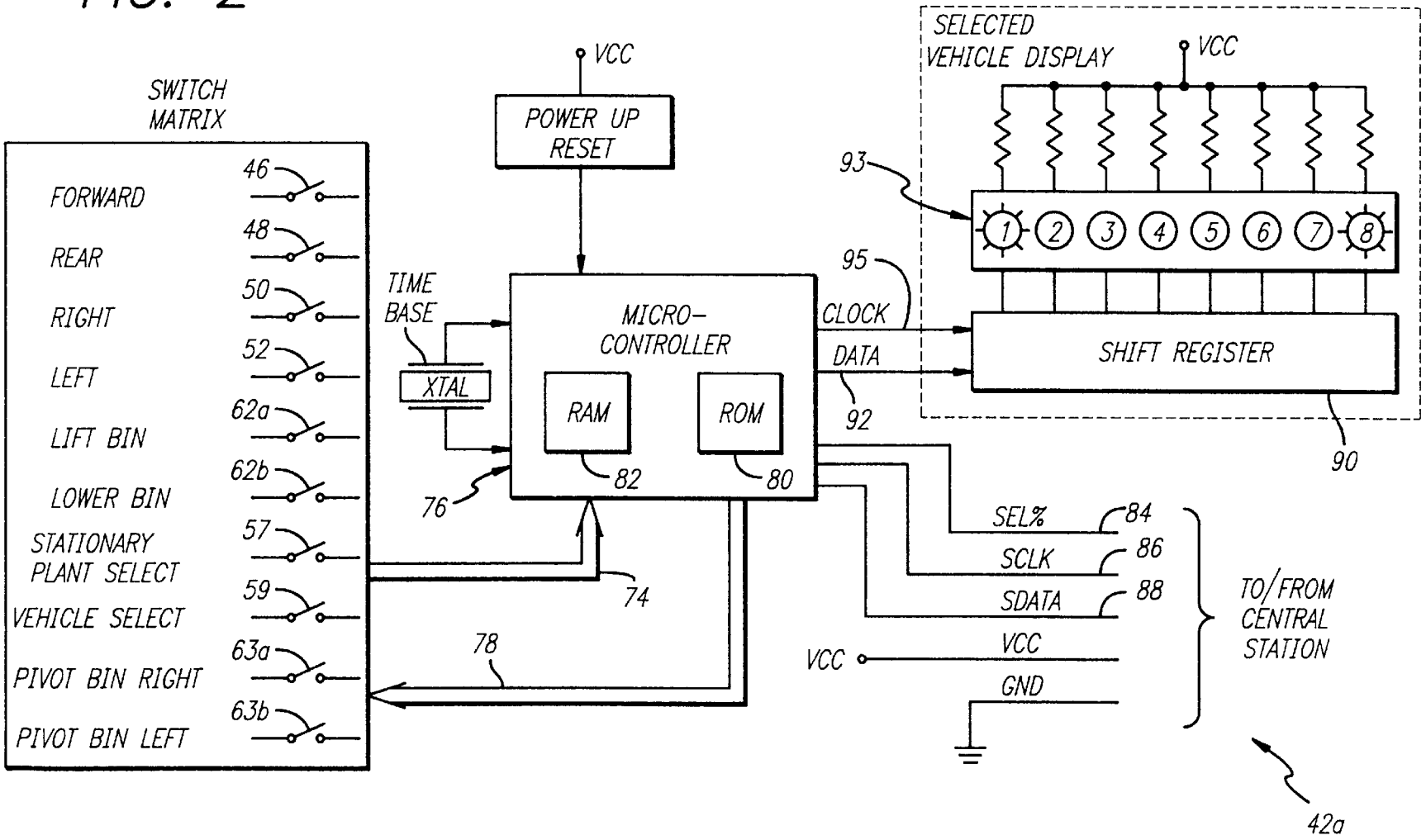
FIG. 2 is a schematic diagram, primarily in block form, of a control pad control system incorporated in the system shown in FIG. 1.

Each of the control pads 42*a,* 44*b,* 42*c* and 42*d* includes a button 56 (FIG. 1) connected to switch 57 (FIG. 2). Successive depressions of the button 56 within a particular period of time cause different ones of the stationary accessories or plants such as pumping station 34 and conveyer 38. For example, a first depression of the button 56 in one of the control pads 42*a,* 42*b,* 42*c* and 42*d* may cause the pumping station 34 to be energized and a second depression of the button 56 within the particular period of time in such control pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A vehicle selection button 58 is provided in each of the control pads 42*a,* 42*b,* 42*c* and 42*d* to select one of the vehicles 12, 14, 16 and 17. The individual one of the vehicles 12, 14, 16 and 17 selected at any instant by each of the control pads 42*a,* 42*b,* 42*c* and 42*d* is dependent upon the number of times that the button is depressed in that control pad within a particular period of time. For example, one (1) depression of the button 58 may cause the dump truck vehicle 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the control pad 42 to count the number of depressions of the button 58 within the particular period of time. The count is converted into a plurality of binary signals indicating the count. The count is provided at the end of the particular period of time. Each individual count provides for a selection of a different one of the vehicles 12, 14, 16 and 17. The count representative of the selection of one of the vehicles 12, 14, 16 and 17 is maintained in a memory, which may be located either in the control pads 42*a,* 42*b,* 42*c* and 42*d,* or in the central station 64.

The control pads 42*a,* 42*b,* 42*c* and 42*d* include buttons 60*a* and 60*b*. When depressed, the buttons 60*a* and 60*b* respectively close switches 62*a* and 62*b* in FIG. 2. The closure of the switch 62*a* is instrumental in producing an operation of the motor 32 to lift the bin 18 in the dump truck 12 when the dump truck has been selected by the proper number of depressions of the button 58. In like manner, when the dump truck 12 has been selected by the proper number of depressions of the switch 58, closure of the switch 62*b* causes the bin 18 in the dump truck 12 to move downwardly as a result of the operation of the motor 32 in the reverse direction.

It will be appreciated that other controls may be included in each of the control pads 42*a,* 42*b,* 42*c* and 42*d*. For example, buttons 61*a* and 61*b* may be included in each of the control pads 42*a,* 42*b,* 42*c* and 42*d* (FIG. 1) which operate upon depression to close respective second accessory switches 63*a* and 63*b* (FIG. 2) to pivot the bin 18 to the right or left when the vehicle 12 has been selected. Such pivotal movements of bin 18 facilitate loading, transportation and unloading of transportable elements such as marbles 26 or blocks 24. It will be appreciated that different combinations of buttons may be actuated simultaneously to produce different combinations of motions. For example, a bin in a selected one of the vehicles may be moved at the same time that the selected one of the vehicles is moved.

A central control station, generally indicated at 64 in FIG. 1, processes the signals from the individual ones of the control pads 42*a,* 42*b,* 42*c* and 42*d* and sends the processed signals to the vehicles 12, 14, 16 and 17 when the button 58 on an individual one of the control pads has been depressed to indicate that the information form the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the control pads. When the commands from the individual ones of the control pads 42*a,* 42*b,* 42*c* and 42*d* are to pass to the stationary accessories 34 and 38 as a result of the depression of the buttons 56 on the individual ones of the pads, the central station process the commands and sends signals through cables 70 to the selected ones of the stationary accessories.

FIG. 2 shows the construction of the control pad 42*a* in additional detail. It will be appreciated that each of the control pads 42*b,* 42*c* and 42*d* may be constructed in a substantially identical manner to that shown in FIG. 2. As shown in FIG. 2, the control pad 42*a* includes the switches 46, 48, 50 and 52 and the switches 57, 59, 62*a,* 62*b,* 63*a* and 63*b*. Buses 74 are shown as directing signals from the switches 46, 48, 50, 52, 57, 59, 62*a,* 62*b,* 63*a* and 63*b* to a microcontroller, generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the control pad 42*a* provide indications of whether or not they have been closed. The random access memory 82 may receive this sequence from the read only memory 80 and may store indications of whether or not the switches in the particular sequence have been closed for each individual one of the control pads 42*a*, 42*b*, 42*c* and 42*d*.

The control pad 42*a* in FIG. 2 receives the interrogating signals from the central control station 64 through a line 84. These interrogating signals are not synchronized by clock signals on a line 86. Each of the interrogating signals intended for the control pad 42*a* may be identified by an address individual to such control pad. When the control pad 42*a* receives such interrogating signals, it sends to the central control station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the control pad 42*a* selects one of the vehicles 12, 14, 16 and 17 in accordance with the number of closings of the switch 59. As the user of the control pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED), generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the control pad 42*a* has selected at such instant.

The central control station 64 is shown in additional detail in FIG. 3. It includes a microcontroller, generally indicated at 94, having a read only memory (ROM) 96 and a random access memory (RAM) 98. As with the memories in the microcontroller 76 in the control pad 42*a*, the read only memory 96 stores permanent information and the random access memory 98 stores volatile (or impermanent) information. For example, the read only memory 96 sequentially selects successive ones of the control pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the control pads 42*a*, 42*b*, 42*c* and 42*d* is being interrogated at each instant, it knows the individual one of the control pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the control pad 42*a* can provide an address indicating the control pad 42*a* when the microcontroller sends the binary signals relating to the status of the switches 46, 48, 50 and 52 and the switches 57, 59, 62*a*, 62*b*, 63*a* and 63*b* to the central control station 64.

As an example of the information stored in the random access memory 98 in FIG. 3, the memory stores information relating to each pairing between an individual one of the control pads 42*a*, 42*b*, 42*c* and 42*d* and a selective one of the vehicles 12, 14, 16 and 17 in FIG. 1 and between each individual one of such control pads and a selective one of the stationary accessories 34 and 38. The random access memory 98 also stores the status of the operation of the switches 46, 48, 50 and 52 for each control pad and the operation of the switches 57, 59, 62*a*, 62*b*, 63*a* and 63*b* for each control pad.

When the central control station 64 receives from the control pad 42*a* the signals indicating the closure (or the lack of closure) of the switches 46, 48, 50 and 52 and the switches 57, 59, 62*a*, 62*b*, 63*a* and 63*b*, the central control station retrieves from the read only memory 96 the address of the individual one of the vehicles indicated by the closures of the switch 59 in the control pad. The central control station may also retrieve the address of the control pad 42*a* from the read only memory 96.

The central control station 64 then formulates in binary form a composite address identifying the control pad 42*a* and the selected one of the vehicles 12, 14, 16 and 17 and stores this composite address in the random access memory 98. The central control station 64 then provides a packet or sequence of signals in binary form including the composite address and including the status of the opening and closing of each of the switches in the control pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the control pad 42*a* is introduced through a line 102 (FIG. 3) to a radio frequency transmitter 104 in the central control station 64. The radio frequency transmitter 104 is enabled by a signal passing through a line 106 from the microcontroller 94.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central control station 64 will respond to such packet of signals.

The microcontroller 94 stores in the random access memory 98 the individual ones of the vehicles such as the vehicles 12, 14, 16 and 17 being energized at each instant by the individual ones of the control pads 42*a*, 42*b*, 42*c* and 42*d*. Because of this, the central control station 64 is able to prevent the interrogated one of the control pads 42*a*, 42*b*, 42*c* and 42*d* from selecting one of the energized vehicles. Thus, for example, if the vehicle 14 is being energized by one of the control pads 42*a*, 42*b*, 42*c* and 42*d* at a particular instant, a first depression of the button 58 in the control pad being interrogated at that instant will cause the vehicle 12 to be initially selected and a second depression of the button by such control pad will cause the vehicle 14 to be skipped and the vehicle 16 to be selected.

Furthermore, in the example above where the control pad 42*a* has previously selected the vehicle 14, the microcomputer 94 in the central control station 64 will cause the vehicle 14 to be released when the control pad 42*a* selects any of the vehicles 12, 16 or 17. When the vehicle 14 becomes released, it becomes available immediately thereafter to be selected by any one of the control pads 42*a*, 42*b*, 42*c* and 42*d*. The release of the vehicle 14 by the control pad 42*a* and the coupling between the control pad 42*a* and a selected one of the vehicles 12, 14, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central control station 64 because the central control station may receive AC power from a wall socket via a transformer 65 and cable 65*a* (FIG. 1). The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged. Charging capability is additionally provided to system 10 by any of a number of possible configurations including locations in the junction box station 35 or as separate stationary plants or other types of accessories such as those depicted by 34 and 38 (FIG. 1) any of which may be placed conveniently throughout the system 10 as desired by the users.

Each central control station 64 may have the capabilities of servicing only a limited number of control pads. For example, each central control station 64 may have the capabilities of servicing only the four (4) control pads 42*a*, 42*b*, 42*c* and 42*d*. It may sometimes happen that the users of the system elect to service more than four (4) control pads. Under such circumstances, the microcontroller 94 in the central control station 64 and a microcontroller, generally indicated at 94*a*, in a second central control station corresponding to the central control station 64 may be connected by cables 114*a* and 114*b* to an adaptor, generally indicated at 115.

One end of the cable 114*b* is constructed so as to be connected to a ground 117 in the adaptor 115. This ground operates upon the central control station to which it is connected so that such central control station is a slave to, or subservient to, the other central control station. For example, the ground 117 in the adaptor 115 may be connected to the microcomputer 94*a* so that the central control station including the microcomputer 94*a* is a slave to the central control station 64. When this occurs, the microcontroller 94 in the central control station 64 serves as the master for processing the information relating to the four (4) control pads and the four (4) vehicles in its system and the four (4) control pads and the four (4) vehicles in the other system as configured in this embodiment.

The expanded system including the microcomputers 94 and 94*a* may be adapted so that the address and data signals generated in the microcomputer 94*a* may be transmitted by the antenna 68 in the central control station 64 when the central control station 64 serves as the master station. The operation of the central control station 64*a* may be clocked by the signals extending through a line 118 from the central control station 64 to the adaptor 115 and through a corresponding line from the other central control station to the adaptor.

The microcontroller 122 of the vehicle 12 (FIG. 4) includes a read only memory (ROM) 124 and a random access memory (RAM) 126. As with the memories in the control pad 42*a* and the central control station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

Figure 4:
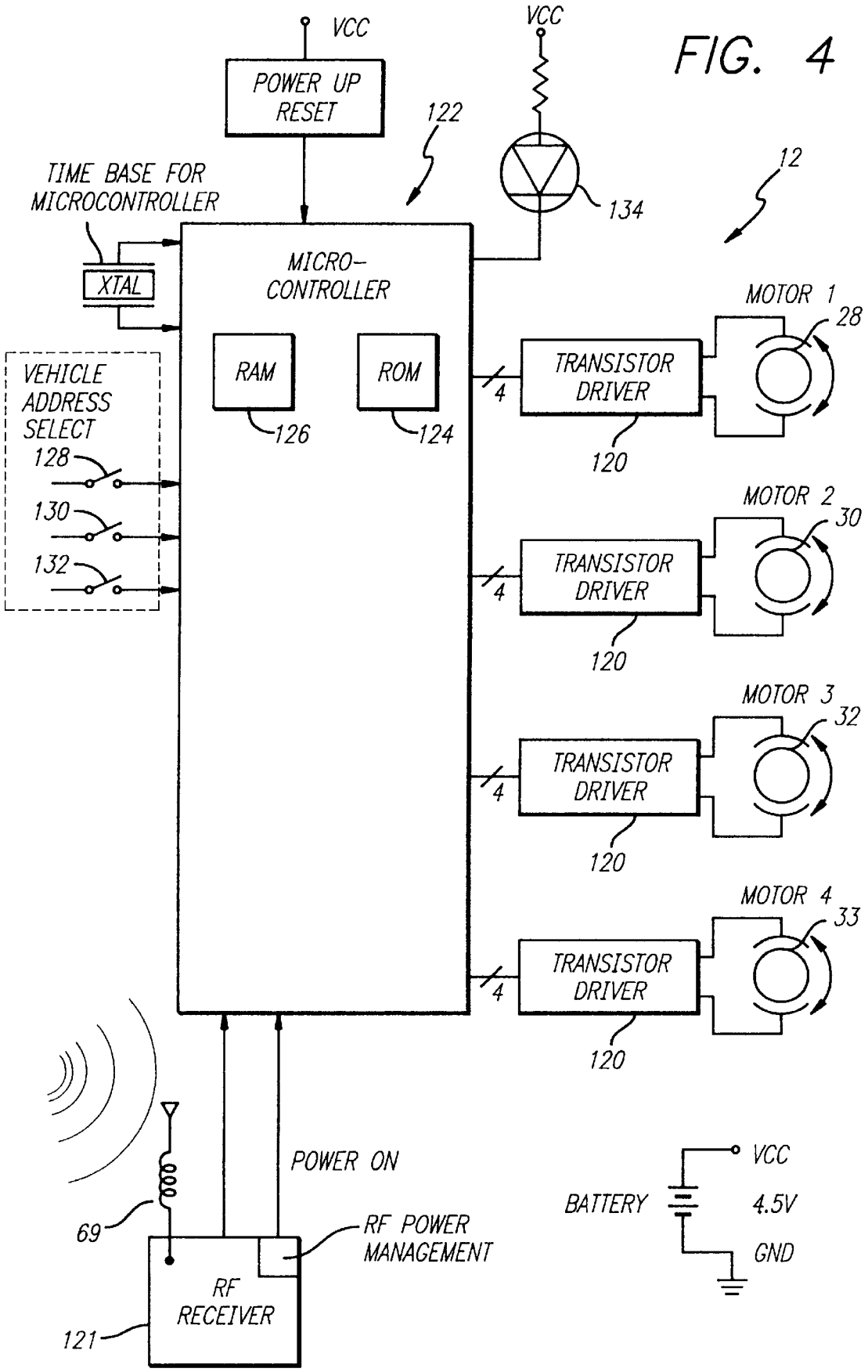
FIG. 4 is a schematic diagram, primarily in block form, of the different features in a vehicle included in the system shown in FIG. 1.

The particular embodiment reflected by vehicle 12 includes a plurality of switches 128, 130 and 132 (FIG. 4). These switches are generally pre-set at the factory to indicate a particular Arabian number such as the number "5". However, the number can be modified by the user to indicate a different number if two central control stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17. Additional switches similar to the switches 128, 130 and 132 and configured to work in cooperation with such switches may be added to the vehicles to accommodate addressing of larger numbers of vehicles so that each may have its own unique address.

The pattern of closure of the switches 128, 130 and 132 in one of the vehicles can be changed when there is only a single central control station. For example, the pattern of closure of the switches 128, 130 and 132 can be changed when there is only a single central control station with a vehicle identified by the numeral "5" and when another user brings to the central control station, from such other user's system, another vehicle identified by the numeral "5".

The vehicle 12 also includes a light such as a light emitting diode 134. This diode is illuminated when the vehicle 12 is selected by one of the control pads 42*a*, 42*b*, 42*c* and 42*d*. In this way, the other users can see that the vehicle 12 has been selected by one of the control pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously described, the user of one of the control pads such as the control pad 42*a* selects the vehicle 12 by successively depressing the button 58 a particular number of times within a particular time period. This causes the central control station 64 to produce an address identifying the vehicle 12. When this occurs, the central control station 64 stores information in its random access memory 98 that the control pad 42*a* has selected the vehicle 12. Because of this, the user of the control pad 42*a* does not thereafter have to depress the button 58 during the time that the control pad 42*a* is directing commands through the station 64 to the vehicle 12. As long as the buttons on the control pad 42*a* are depressed within a particular period of time to command the vehicle 12 to perform individual functions, the microprocessor 94 in the central control station 64 will direct the address of the vehicle 12 to be retrieved from the read only memory 96 and to be included in the packet of the signals transmitted by the central control station to the vehicle 12.

The read only memory 96 in the microprocessor 94 at the central control station 64 stores information indicating a particular period of time in which the vehicle 12 has to be addressed by the control pad 42*a* in order for the selective coupling between the control pad and the vehicle to be maintained. The random access memory 98 in the microcontroller 94 stores the elapsed period of time from the last time that the control pad 42*a* has issued a command through the central control station 64 to the vehicle 12. When the elapsed period of time in the random access memory 98 equals the period of time in the read only memory 96, the microcontroller 94 will no longer direct commands from the control pad 42*a* to the vehicle 12 unless the user of the control pad 42*a* again depresses the button 58 the correct number of times within the particular period of time to select the vehicle 12.

The vehicle 12 also stores in the read only memory 124 indications of the particular period of time in which the vehicle 12 has to be addressed by the control pad 42*a* in order for the selective coupling between the vehicle and the control pad to be maintained. This period of time is the same as the period of time specified in the previous paragraph. The random access memory 126 in the microcontroller 122 stores the elapsed period of time from the last time that the control pad 42*a* has issued a command to the vehicle 12.

Once the particular button 58 of particular pad has been actuated to select and energize a vehicle, that vehicle remains operative and associated with such particular pad for a predetermined period of time as dictated by random access memory 126. When the elapsed period of time stored in the random access memory 126 of the microcomputer 122 in the vehicle equals the period of time in the read only memory 124, the microcontroller 122 issues a command to extinguish the light emitting diode 134. This indicates to the different users of the system, including the user previously controlling the operation of the vehicle 12 that the vehicle is available to be selected by any one of the users, including the user previously directing the operation of that vehicle.

When one of the vehicles such as the vehicle 12 is being moved in the forward direction, the random access memory 126 records the period of time during which such forward movement of the vehicle 12 is continuously occurring. This count is continuously compared in the microcontroller 122 with a fixed period of time recorded in the read only memory 124. When the period of time accumulated in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a cooperative basis. Furthermore, the vehicles can be operated on a flexible basis in that a vehicle can be initially selected for operation by one user and can then be selected for operation by another user after the one user has failed to operate the vehicle for a particular elapsed period of time. The vehicles being operated at each instant are also visible by the illumination of the lights 134. The apparatus and method of this invention are also advantageous in that the vehicles are operated by the central control station 64 on a wireless basis without any physical or cable connection between the central control station and the vehicles.

Furthermore, the central control station 64 communicates with the vehicles in the plurality through a single carrier frequency. The system and method of this invention are also advantageous in that the vehicles can selectively perform a number of different functions including forwardly and rearwardly movement, as well as turns to the left and to the right, and manipulation of accessories such as containers, bins or platforms carried on the respective vehicles. Different movements can also be provided simultaneously on a coordinated basis. Vehicles may also be employed in a cooperative manner to work with stationary plants and accessories 34 and 38 for the movement and storage of materials such as blocks 24 and marbles 26.

Figure 5B:
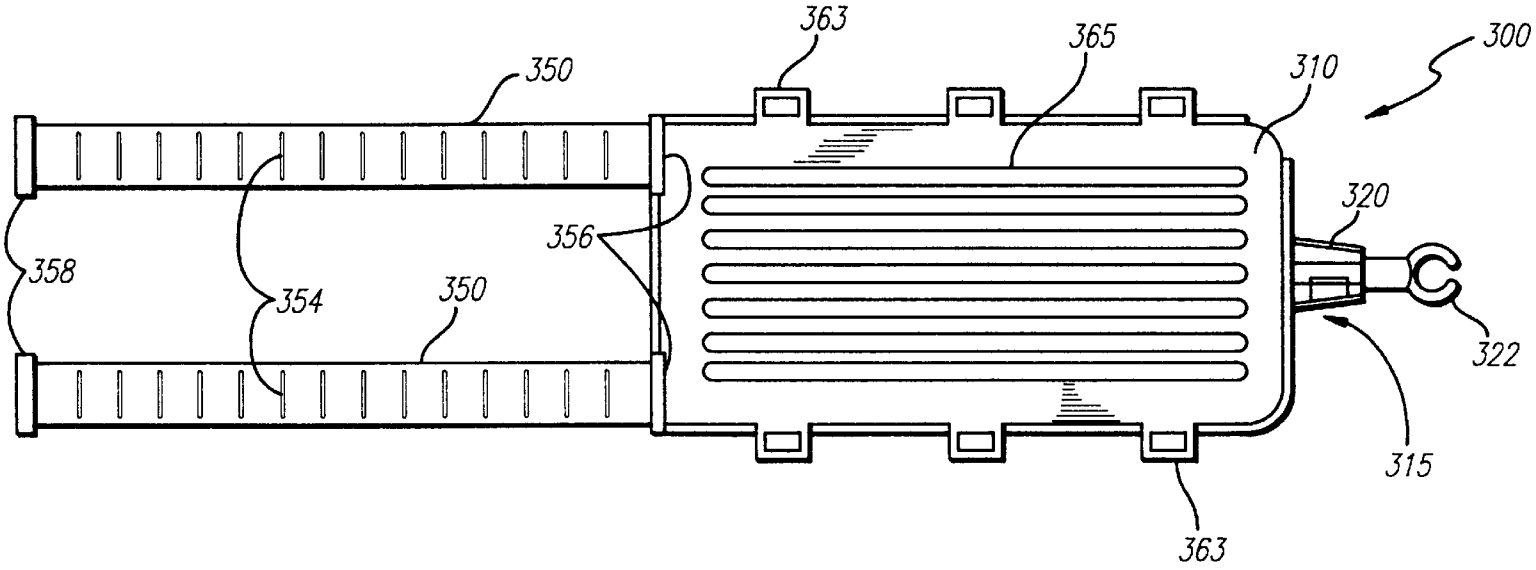
FIG. 5B is a top view of the vehicle shown in FIG. 5A.
Figure 5A:
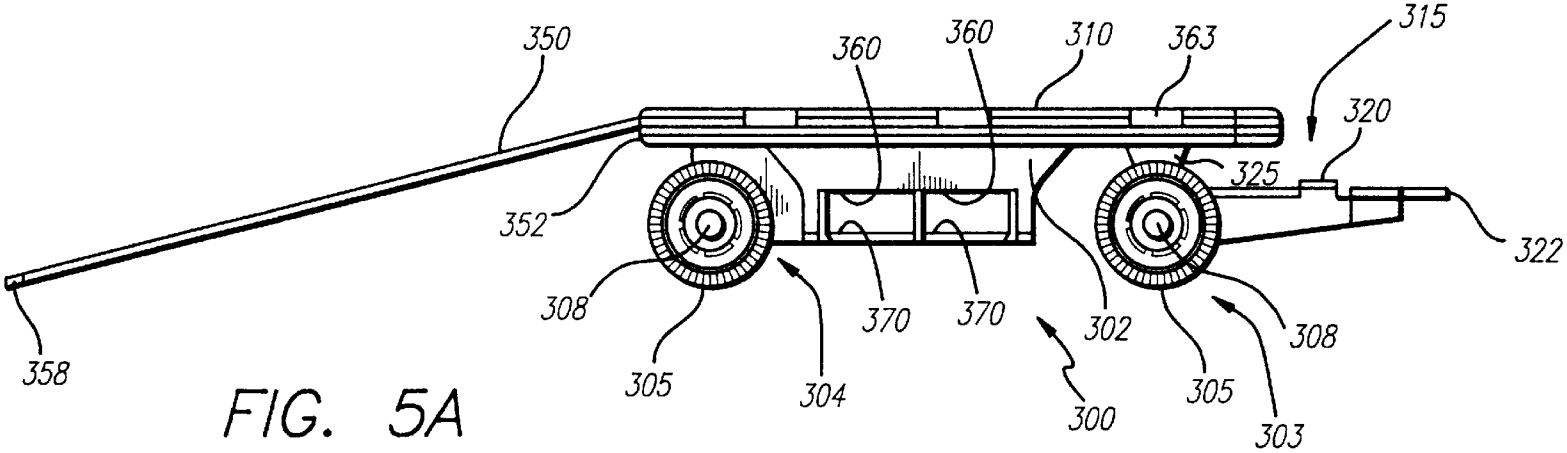
FIG. 5A is a side view of an embodiment of a flat-bed trailer vehicle which incorporates an automatic, self-leveling trailer hitch assembly.

Another embodiment of a toy vehicle of the type disclosed herein and compatible for use with system 10 includes a toy trailer useful in such a system for towing or hauling other vehicles, objects and materials, is indicated generally at 300 in FIGS. 5A and 5B. Although a flat-bed 310 type of trailer 300 is shown in the preferred embodiment, many types of alternative embodiments of towable trailers are possible which incorporate some or all of the features shown here and include towable containers, bins, storage tanks, other combinations, and self-powered, towable vehicles to name just a few of the possibilities. Many types of vehicles having a means for towing or hauling another vehicle would be compatible with a trailer incorporating the important aspects of this invention.

Problems existing in previous toy trailers used in a standalone manner or as part of various types of play systems include the difficulty or impossibility of automatic hitching of the trailer by a motorized tow vehicle without the assistance of human hands, the inability of a vehicle which is to be towed or hauled to drive up onto and load itself upon a towable trailer and the inability of previous toy trailers to traverse inclines and declines of moderate to steep slopes while being towed by another vehicle without causing the tow vehicle to lift up and off the plane of the inclining or declining surface being navigated because of inadequate range of angular and rotational displacement of the trailer hitch. Additionally, it is often difficult and frustrating, if not altogether impossible, for a user to maneuver a towed trailer about in tight spaces or to turn in small radii curves and travel up or down steep slopes.

The toy trailer indicated generally at 300 in FIGS. 5A and 5B, includes generally a vehicle chassis 302 having four wheels 305 (only the wheels 305 on the right side are shown). The chassis or frame 302 incorporates a forward steerable axle assembly 303 and a rearward axle assembly 304 with each assembly having respective front and rear axles 308 each having wheels 305 carried from their respective opposite ends.

The front and rear axles 308 of this embodiment are spaced apart at selected locations on the bottom side of the chassis 302. The distance between the cross-sectional centers of the front axle and the cross-sectional center of the rear axle is typically known in the art as the wheelbase of the vehicle.

In FIGS. 5A and 5B, a flat bed 310 type trailer vehicle 300 is shown but one having ordinary skill in the art will appreciate the applicability of the invention to other types of towable vehicles other than flat-bed trailers as suggested above. The forward steerable axle assembly 303 includes a hitch coupling assembly, indicated generally at 315 (FIGS. 5A and 5B) formed with a forwardly projecting tow bar or trailer tongue 320.

The bed 310 includes anti-skid or friction stabilization pads 365 disposed across the bed. Accessory support elements 363 disposed about the perimeter of bed 310 serve as attach points for side rails, a trailer cover for the bed 310, or as supports for a plurality of motorized accessories mountable to the bed such as a loading crane.

At a rearward end of the trailer 300, the bed 310 is adapted to receive elongated loading ramps 350 having an attachment device 356 at an upper end of the ramps 350 adapted to releasably engage the flat bed 310. From their respective attachment termini at the edge of bed 310 as shown generally in FIG. 5A, the ramps extend rearwardly in a downward incline with a bottom terminus resting on a surface. Ramps 350 have traction pads or ribs 354, disposed laterally across the width of the ramps, and threshold transition bevels or mini-ramps 358, disposed at the lower ends of the ramps. The underside of bed 310 or chassis 302 includes stowage or retaining slots 352 (not shown in detail) for retaining the ramps 350 when not in use by methods well-known to those having ordinary skill in the art.

Figure 6C:
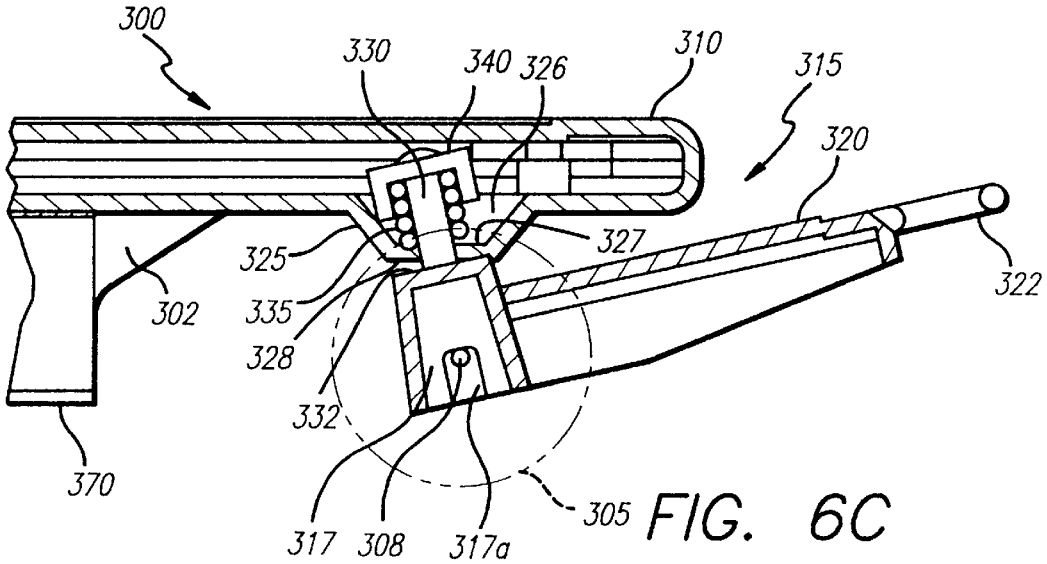
FIGS. 6A, 6B, and 6C are partial cross-sectional views, in enlarged scale, of the automatic, self-leveling trailer hitch assembly shown in FIG. 5A.
Figure 6B:
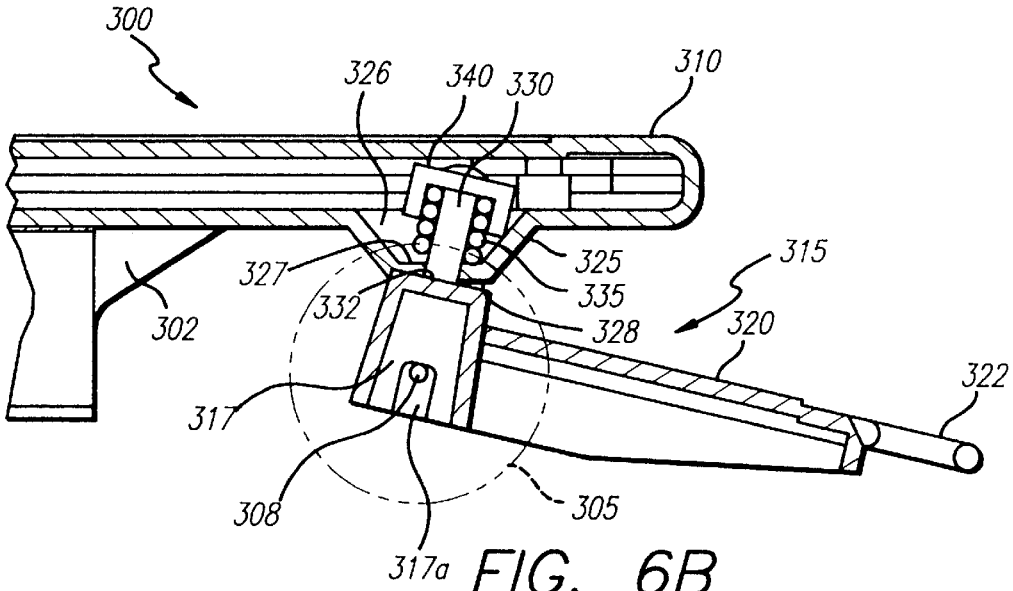
Figure 6A:
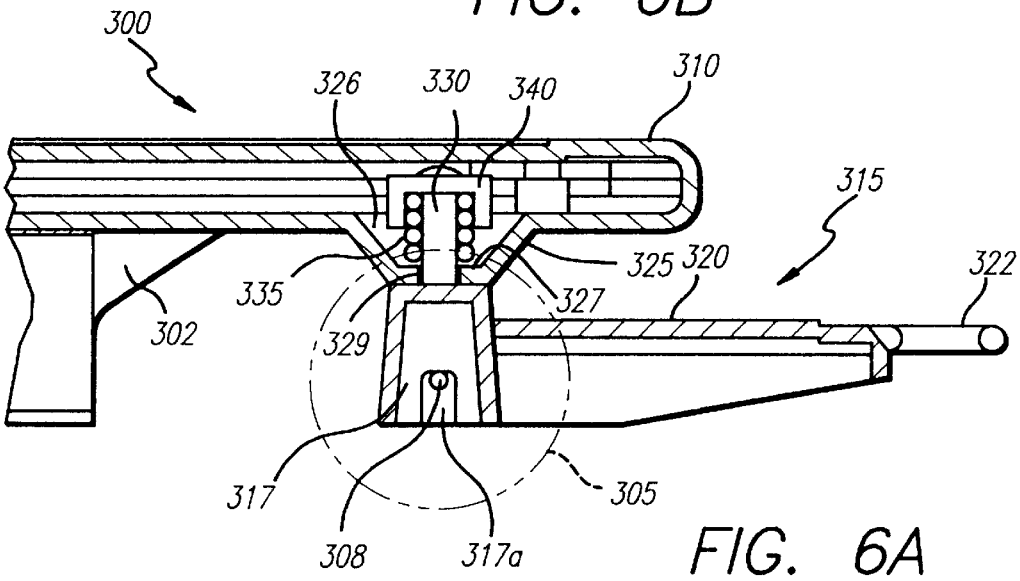

Referring now to FIGS. 6A, 6B and 6C, the coupling assembly 315 includes, fixedly mounted to or integrally formed on the forward underside of the chassis 302, a pin coupler receptacle in the form of a cup-shaped swivel housing 325 which is configured with a hollow chamber 326 (FIG. 6A). Such receptacle 325 is formed with a circular bottom wall configured with a central bore 329 and having a flat downwardly facing bearing surface.

Interposed between the swivel housing 325 and the axle 308 is a hollow axle support housing 317 formed with a flat top wall an upwardly facing load bearing pad 332, a lower end and laterally opposite side walls formed with downwardly opening slots 317*a* adapted to receive the axle 308 as shown in FIG. 6A. The tow bar 320 is rigidly attached to such housing and projects forwardly therefrom to be formed with a hitch ring 322. Projecting upwardly from the center of the pad 332 for receipt in the bore 329 is a leveling stem 330 surmounted by a retainer cap 340. Telescoped over such pin and constraint between the cap 340 and bottom wall 327 is a coil compression spring 335 operative to draw the housing toward the bottom surface 328 to normally maintain the top wall 332 of such housing flush against the bottom bearing surface 328. In the preferred embodiment, the bar or tongue 320 is rigidly disposed at a right angle to the pin or stem 330 and the resilient constrainable member 335 comprises a helical compression spring.

The pin or leveling stem 330 of axle housing 317 is adapted to bidirectionally rotate about its own longitudinal axis to facilitate steering of the forward axle assembly 303. The leveling stem 330 is of a diameter and length to be received for free rotation in the bore 329 and to provide for freedom of the axle housing 317 to rock angularly forwardly and rearwardly relative to the receptacle 325 as dictated by the raising and lowering of the tongue to the respective positions shown in FIGS. 6C and 6B. As shown in FIG. 6C, when the free end of the tongue 320 is raised, the axle housing 317 will rock forwardly against the bias of the spring 335 pivoting quarterly on the front edge of the downwardly facing bearing surface 328 causing the axle 308 to be displaced slightly forwardly of the vertical plane through the center of the bore 329. Referring to FIG. 6C, it will be appreciated that the weight of the front of the trailer and any load thereon will act generally downwardly through the point where the forward underside 338 of receptacle 325 contacts the forward upperside 332 of the housing support 317 to cooperate with the force acting upwardly on the axle to generate a clockwise torque on the axle housing 317, as viewed in FIG. 6C, tending to rotate such housing 317 clockwise about the point described above thereby tending to urge the free end of such tongue downwardly to the hitching position shown in FIG. 6A.

Figure 7:
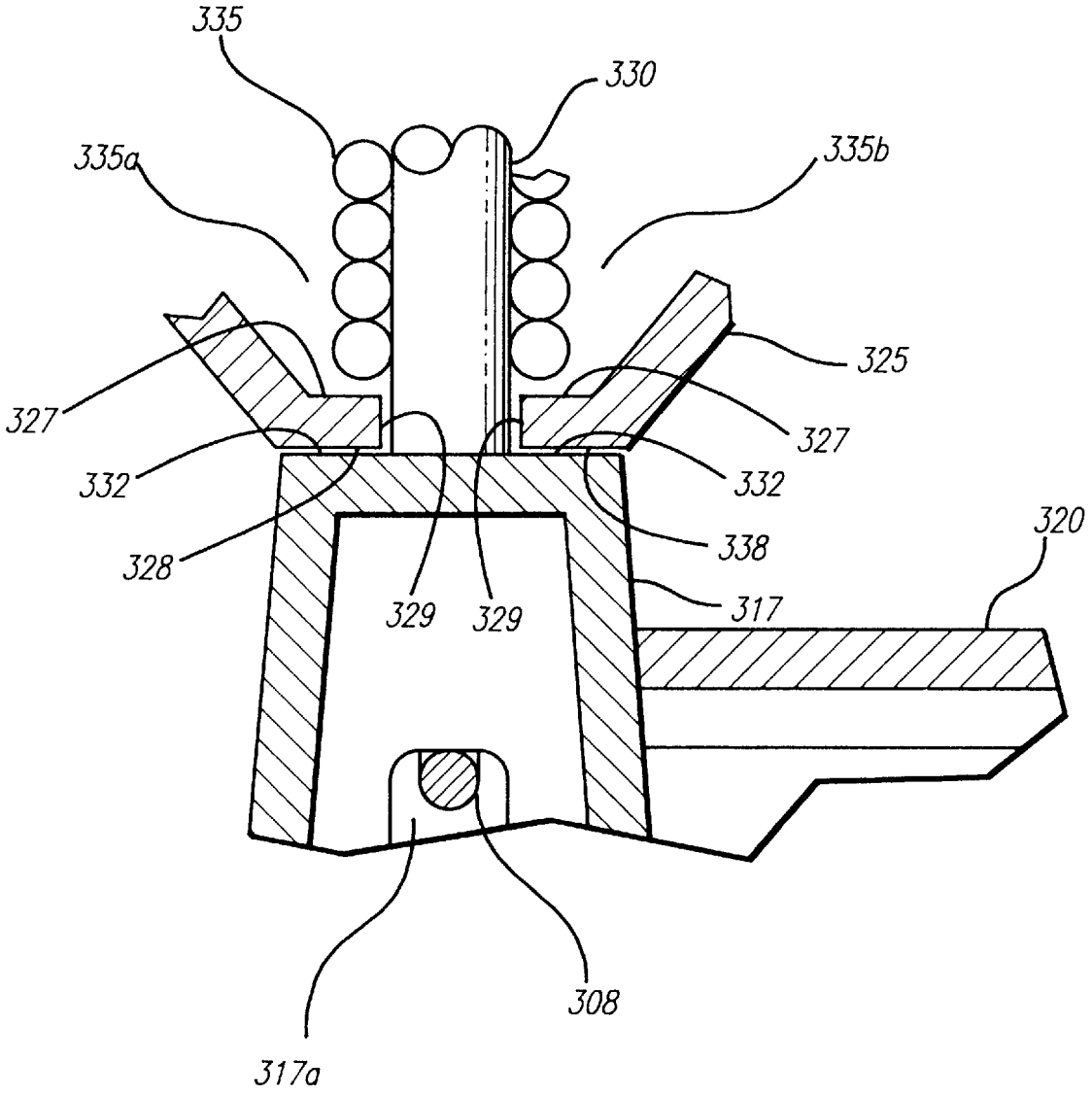
FIG. 7 is a partial cross-sectional view, in enlarged scale, of the automatic, self-leveling trailer hitch assembly shown in FIG. 5A.

In operation, the hitch coupling assembly 315 (FIG. 6A) serves to normally maintain the tow bar 320 in a level position parallel to the flat-bed 310 of the trailer 300 when unhitched from a tow vehicle. The force generated by the spring 335 to maintain the pin or leveling stem 330 at right angles to the trailer 300 results from the asymmetric forces imposed upon the opposite sides 335*a*, 335*b* (FIG. 7) of the spring when the tow bar is not parallel to the trailer 300. This is shown in FIGS. 6B and 6C. In FIG. 6B, the tow bar 320 is driven downwardly from the trailer 300 which imposes a greater constraining force on the right side 335*b* of the spring 335 than on the left side 335*a* of the spring. In FIG. 6C, the tow bar 320 is driven upwardly from the trailer 300 to impose a greater force on the left side 335*a* of the spring 335 that on the right side 335*b* of the spring. The asymmetric forces on the opposite sides 335*a* and 335*b* of the spring 335 cause the spring to produce a force for pivoting the pin or stem 330 in the opening 329 to move the pin to a substantially perpendicular relationship to the trailer 300 as shown in FIG. 6A.

As described above, when at rest the leveling spring 335 will apply an upwardly acting biasing force on the pin cap 340 as shown in FIG. 6A to tend to thus draw such pin 330 upwardly relative to the swivel receptacle 325 thereby maintaining the flat top surface of the top wall 332 of the axle housing 317 flush against the downwardly facing pad 325 on the bottom of such receptacle thereby maintaining such housing in its vertical orientation to maintain the axle 308 in the vertical plane of the axis of such pin 330. This then tends to maintain the tongue 320 rigidly mounted to such housing disposed in its horizontal hitching position for ready access by the hitch 19 of a vehicle such as vehicle 14. Then, when it is desirable for the player operating the control pad 42 (FIG. 1) to effect maneuvering of such trailer into position to make the hitching connection, such pad may be operated to maneuver the vehicle 14 (FIG. 1) about and back its hitching pin 19*a* into alignment with the tongue hitch eye 322. The vehicle 21 auxiliary motor 32 may then be operated to drop a hitch pin 19*a* into the eye 322 and complete the hitching operation.

Figure 9:
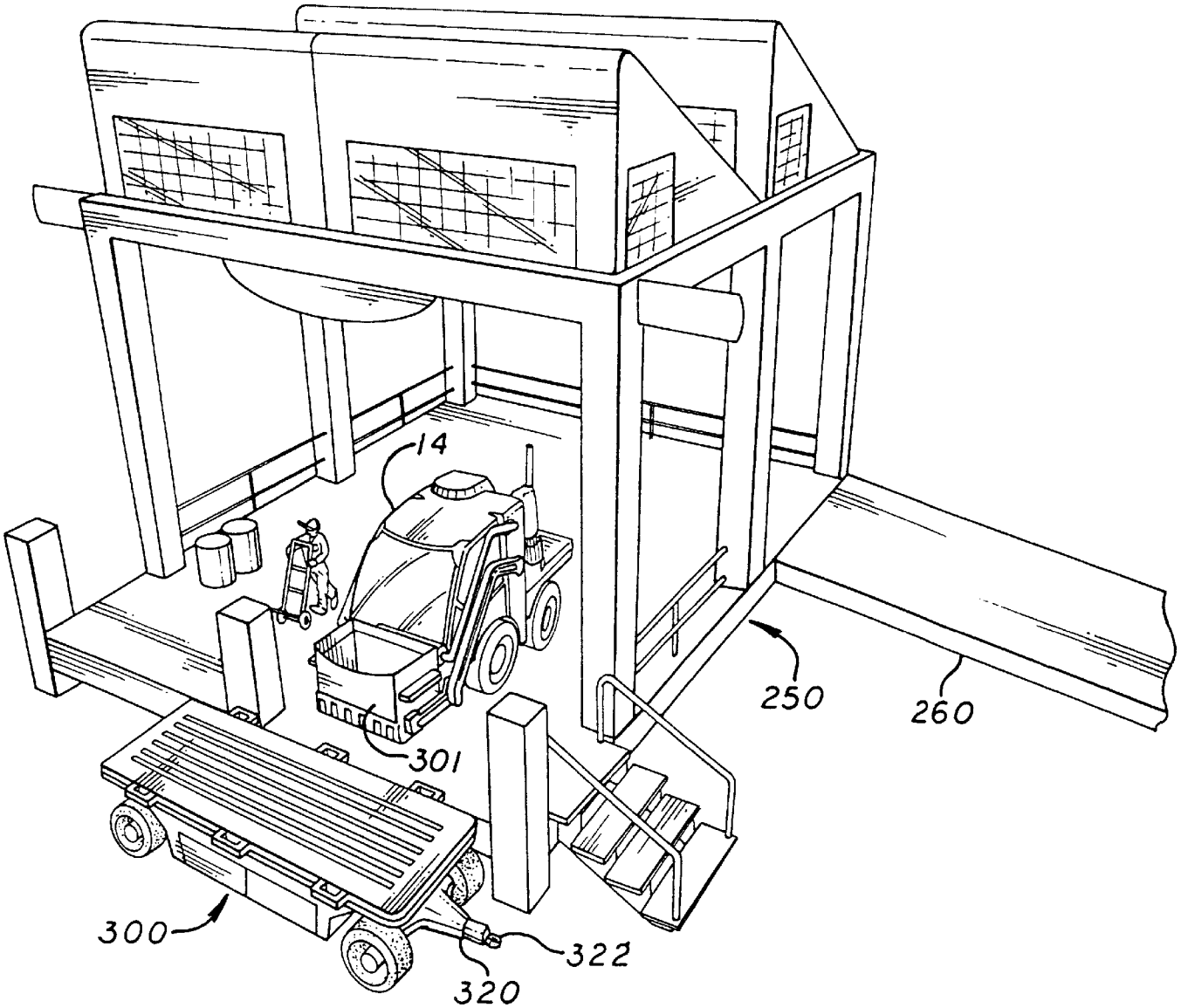
FIG. 9 is an elevational view, in reduced scale, of the flat-bed trailer vehicle shown in FIG. 5A being loaded by a self-propelled, remotely-controlled vehicle.

Once the hitch operation has been accomplished, the vehicle 14 may then be maneuvered about by the operator to travel up and down ramps, such as that indicated at 260 in FIG. 9, and over terrain as desired. It will be appreciated that as the vehicle 14 is maneuvered about by the operator through turns, over undulations and the like, the tongue 320 will follow the hitch. As the tongue 320 is drawn to the right or left, the axle housing 317 will pivot underneath the receptacle 325 about the axis of the pin 320 to permit the axle 308 to turn relative to the trailer 300.

Then, when the vehicle 14 starts up an inclined ramp or the like, the free end of the tongue 320 will be pivoted upwardly from the hitching position shown in FIG. 6A to the position shown in FIG. 6C. The upward force applied to the free end of the tongue 320 as the vehicle 14 moves up the ramp 260 will tend to pivot the axle housing 317 about the front edge of the bearing surface 328 of the bottom wall of such receptacle 325 to draw the pin 330 downwardly in the bore 329 against the bias of the compression spring 335 asymmetrically loading opposite sides 335*a* and 335*b* (FIG. 7) of the spring. It will be appreciated that the pin 330 will thus be inclined within the bore 329 against the asymmetrical load applied to the cap 340 tending to upright the pin 330 within the cavity 326. The pin 330 will also be free to rotate about its own axis within such bore 329 thereby providing for the tongue 320 to be maneuvered through compound angles both upwardly and sideways relative to the trailer 300 to thereby permit turning of such trailer 300 in the event the ramp 260 is approached from other than a straight on direction.

Thereafter, when the vehicle 14 is turned around and starts down a ramp 260 or other incline, it will be appreciated that the free end of the tongue 320 can be pivoted downwardly from the position shown in FIG. 6C to the position shown in FIG. 6B as provided for by rocking of the axle housing 317 underneath the receptacle 325 about the back edge of the bearing surface 328 as shown in FIG. 6B. Thereafter, when the vehicle 14 draws the trailer to the rest position for parking the control pad may be operated to retract the hitch pin 19*a* of hitch 19 and free the tongue 320. Then as the vehicle 14 pulls away, the tongue 320 will be left in its level unhitched position shown in FIG. 6A.

It will be appreciated that even if the trailer 300 is lowered with a relatively heavy load, return of such tongue 320 to this level unhitched position will be assured. The force of the spring 335 urging reorientation of the pin 330 to its vertical position as shown in FIG. 6A, due to the uniform application of forces to the cap 340 symmetrical about the axis of such pin, tends to establish the level orientation of the tongue 320. Such leveling force of the spring 335 is augmented by the weight of the trailer 300 applied downwardly on the axle housing 317 as enhanced by any load on such trailer 300. That is, the weight of the tongue 320 carried cantileverally from the housing 317 tending to apply a clockwise torque to such housing 317 as viewed in FIG. 6C will be overcome by the force of the spring 335 acting symmetrically on the cap 340 and the weight of the trailer 300 and any load acting downwardly on the receptacle 325 along a force line in a substantial vertical plane through the axis of the pin 330 and the axle 308. This force tends to resist the clockwise torque applied by the weight of the tongue 320 since clockwise rotation of such axle housing 317 about the back edge of the bottom surface of the receptacle bearing pad 328 is resisted by the weight acting downwardly to such receptacle 325 essentially along the axis of the pin 330 to thereby maintain a counterclockwise torque on such housing 317.

This particular embodiment of the trailer 300 also incorporates many other features heretofore available only on full-sized, industrial vehicles. One such feature provides for a wheeled or tracked vehicle to drive under its own power, up ramps 350 and thereby load itself onto the bed 310 of the trailer 300. In an alternative embodiment, a single ramp having sufficient width to accommodate the track of a vehicle to be loaded on to the flat bed 310 (not shown) may be used in place of the dual ramps 350. In the dual ramp 350 configuration, a self-powered vehicle such as the vehicle 12 is operated by a player providing directional and translational inputs to the pads 42 to approach the lower end of the ramps 350 aligning the wheels with the ramps. Continued operation of the vehicle 12 provides translation of the vehicle 12 up the ramps, assisted from sliding in the downward, reverse direction, against the rotational direction of the wheels of vehicle 12, by non-slip, traction pads or ribs 354. Once loaded upon the bed 310, the ramps are pushed into slots and stowed on the trailer 300 in a position such as slots 352. The vehicle 12 is stabilized on the bed during hauling by non-slip, anti-skid pads 365.

Figure 8:
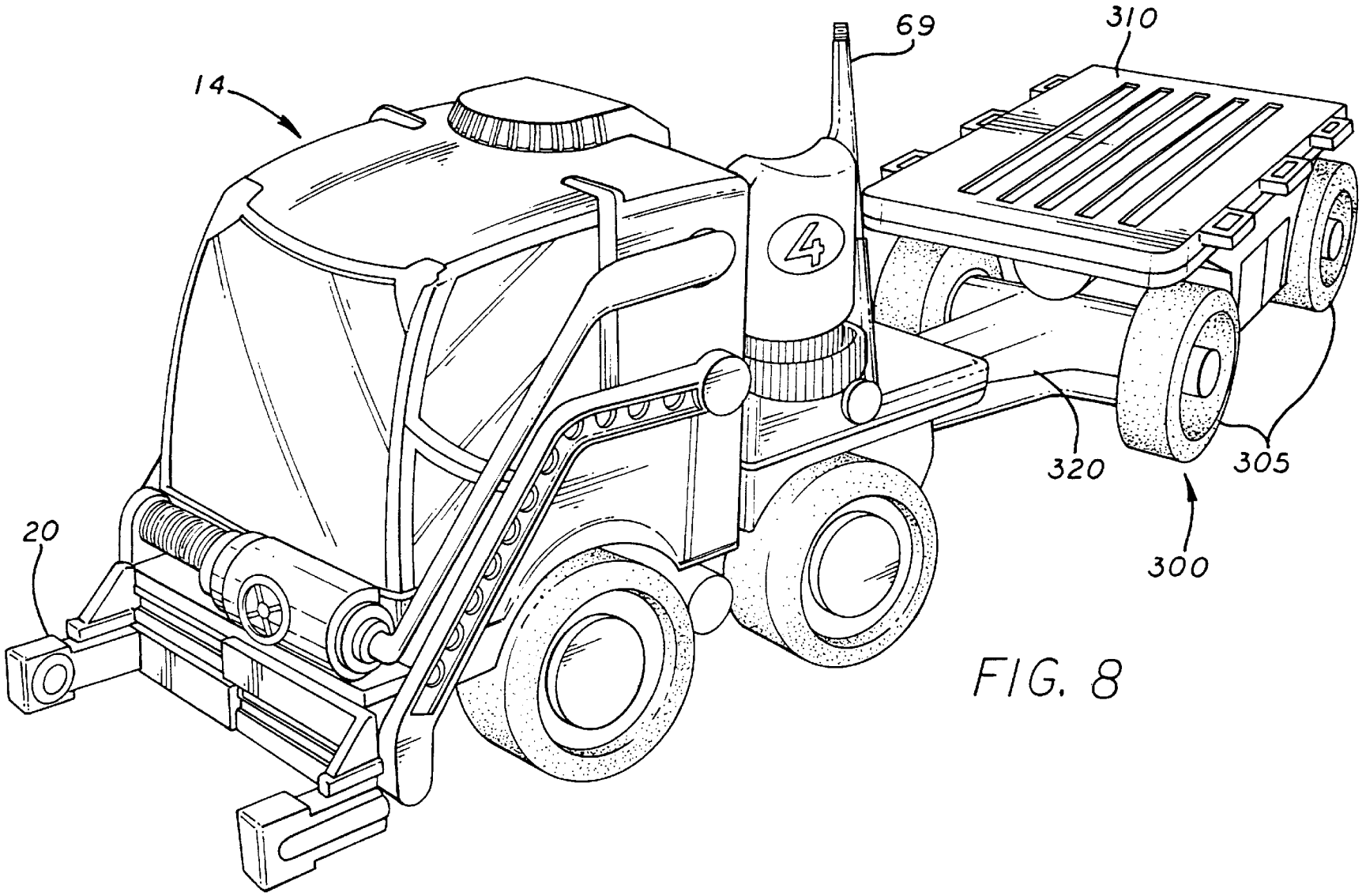
FIG. 8 is an elevational view, in reduced scale, of the flat-bed trailer vehicle shown in FIG. 5A being towed by a self-propelled, remotely-controlled vehicle.

The trailer 300 in a towed configuration is shown generally by FIG. 8 wherein the hitch coupling assembly 320 is rotated providing a steering input to the trailer 300 and providing for proper towed operation. Referring now to FIG. 9, one novel aspect of the construction of the vehicles 12, 14, 16 and 17 will now be described. FIG. 9 shows one embodiment of the fork lift 14 lifting and carrying a bin 301. The fork lift 14 is shown positioned on the raised deck of a miniature model of a loading dock, generally indicated at 250. Also shown in FIG. 9 is the trailer 300 that may be connected to the vehicles 12, 14, 16 and 17 by connecting the hitch ring 322 of the tongue 320 of the trailer 300 to the hitch 19 of a selected one of the vehicles 12, 14, 16 and 17. As is apparent from FIG. 9, the fork lift 14 is capable of grasping the bin 301 with its gripper assembly and upon receiving the appropriate signal from the central station 64 (FIG. 1), can be operated to lift the bin to an elevated position. The operator may then control the fork lift 14 to move forward on the deck of the loading dock 250 until the bin 301 is suspended over the trailer 300. The fork lift can then be controlled to lower the bin 301 onto the trailer 300, and release the gripper assembly 20.

Vehicles and other transportable items may be secured, protected or otherwise retained on the bed 310 during transportation by use of protective covers or perimeter side rails (not shown) adapted to be secured with the accessory support elements 363. Additional transportable items may be stored beneath the flat bed 310 of the trailer 300 in storage bays 370.

Although this invention has been disclosed and illustrated with reference to particular embodiments, the physical and mechanical principles involved are susceptible for use in numerous other embodiments which will be apparent to persons skilled in the art. The invention is, therefore, to be limited only as indicated by the scope of the appended claims.

What is claimed:

1. A toy trailer having a hitch coupling, comprising:

a trailer frame having a swivel housing formed on the underside of a first end of the frame, the swivel housing having a bottom wall having a swivel opening extending therethrough;

an axle assembly including an axle housing interposed between an axle and said swivel housing and a tongue projecting rigidly forwardly to terminate in a free end, said axle housing being movable relative to said swivel housing for rotation of said tongue from an intermediate hitch position to a raised position or a lowered position;

a leveling stem mounted on said axle housing, said leveling stem having an end projecting upwardly through said swivel opening for pivoting in said opening about its own axis and rotatable on its own axis;

a retainer attached to the end of the leveling stem; and a spring mounted on the leveling stem, the spring having a first end bearing upon the bottom wall of the swivel housing and a second end bearing upon the retainer, the spring thereby biasing said axle assembly to position said tongue in said intermediate hitch position.

2. A toy trailer as recited in claim 1 wherein:

said axle housing includes a pair of laterally disposed end walls formed with downwardly opening slots receiving said axle.

3. A toy trailer as recited in claim 1 wherein:

said swivel housing is formed with said bottom wall configured with a flat downwardly facing bearing surface;

said axle housing is formed with a top wall configured with a flat upwardly facing bearing pad disposed in a load carrying relationship under said bearing surface;

said stem projecting centrally upwardly from said bearing pad; and said spring is in the form of a compression spring telescoped over said stem, constrained to the top end of said stem and operative to bias said stem upwardly to draw said bearing pad toward said bearing surface.

4. A toy trailer as recited in claim 1 further comprising:

a ramp member adapted at a first edge to releasibly engage a second end of the trailer frame and adapted at a second edge to rest against a surface; and a second retainer mounted to said second end of said trailer frame adapted to releasably engage said ramp.

5. A toy trailer assembly comprising:

a tow trailer having an axle and wheels disposed on the axle, a receptacle disposed on the underside of the tow trailer and having an opening, a trailer hitch assembly having a first end and a second end and supported on the axle, a pin having a first end disposed on the trailer hitch assembly, and a second end extending through the opening in the receptacle the pin also having first and second opposite sides, the first side facing the first end of the trailer hitch assembly and the second side facing the second end of the trailer hitch assembly, a cap disposed on the pin at the first end of the pin, and a spring disposed on the pin between the cap and the receptacle and operative, upon receiving unequal forces at the first and second opposite sides of the pin, to rotate the trailer hitch assembly to a position wherein the forces received by the spring at the first and second opposite sides of the pin are equal.

6. The toy trailer assembly as set forth in claim 5 the trailer hitch assembly being supported on the axle at the first end of the trailer hitch assembly, the trailer hitch assembly also having a hitch member mounted at the second end of the trailer hitch assembly.

7. The toy trailer assembly as set forth in claim 5 the receptacle having a shoulder and the opening being in the receptacle shoulder, the receptacle defining a chamber at the position of the receptacle shoulder, the pin extending through the opening into the chamber, and the cap being disposed within the chamber.

8. The toy trailer assembly as set forth in claim 7, the chamber having dimensions to provide for a pivoting of the spring, the pin and the cap within the chamber in accordance with the disposition of the trailer hitch assembly relative to the tow trailer.

9. The toy trailer assembly as recited in claim 8 the trailer hitch assembly being supported on the axle at the first end of the trailer hitch assembly, the trailer hitch assembly also having a hitch mounted at the second end of the trailer hitch assembly.

10. The toy trailer assembly as set forth in claim 5 the trailer hitch assembly including a housing for supporting the axle, the axle housing and the receptacle being disposed in abutting relationship and co-operating with the axle, such that when the force on the first side is not equal to the force on the second side of the spring, the spring produces a force to rotate the trailer hitch assembly to an upright disposition of the pin.

11. A toy trailer assembly comprising:

a tow trailer having a forward end and rear end, the forward and rear ends oriented in a first plane, an axle at the rear end of the tow trailer, wheels on the axle, a trailer hitch assembly having first and second opposite end portions oriented in a second plane, the first end portion of the trailer hitch mounted on the axle of the tow trailer, the second end portion having a hitch mounted thereto, a receptacle supported by the tow trailer near the rear end of the tow trailer, the receptacle having a portion shaped to define a chamber and having an opening in the portion, a support disposed on the trailer hitch assembly and extending through the opening in the receptacle for pivotable movement in the chamber, and a resiliently constrainable member having first and second opposite sides, the first side facing the first end of the trailer hitch assembly and the second side facing the second end of the trailer hitch assembly, the resiliently constrainable member disposed on the support, the first and second sides of the resiliently constrainable member each providing a force on the trailer hitch assembly such that the force provided by the first side is equal to the force provided by the second side when the first plane and the second plane are in a predetermined relationship.

12. The toy trailer assembly as set forth in claim 11 the constrainable member being disposed at one end against the receptacle in the portion of the receptacle defining the chamber.

13. The toy trailer assembly as set forth in claim 11 wherein the constrainable member is a helical spring.

14. The toy trailer assembly as set forth in claim 11 portion of the receptacle defining the chamber having a horizontal disposition and the support being pivotable in the chamber such that the force on the first side of the resiliently constrainable member is not equal to the force on the second side of the resiliently constrainable member when the first plane is in a relationship with the second plane different from the predetermined relationship.

15. The toy trailer assembly as set forth in claim 14 the constrainable member being disposed at one end against the receptacle in the portion of the receptacle defining the chamber to become asymmetrically constrained at its opposite sides when the second plane of the trailer hitch assembly is in a relationship with the first plane of the tow trailer different from the predetermined relationship, and the constrainable member is a helical spring.

16. The toy trailer assembly as recited in claim 11 the trailer hitch assembly including an axle support housing, the receptacle and the axle support housing having abutting surfaces with the trailer hitch assembly and the tow trailer in a predetermined relationship, the abutment between the receptacle and the axle support housing being displaced relative to the axle when the relationship between the first plane and the second plane are not in a predetermined relationship to produce a force on the tow trailer for returning the tow trailer to the predetermined relationship with the trailer hitch assembly.

17. A toy trailer assembly comprising:

a tow trailer, an axle on the tow trailer at the rear end of the tow trailer, wheels disposed on the axle, a receptacle disposed on the tow trailer at the rear end of the tow trailer and shaped to define a chamber, a trailer hitch assembly mounted on the axle at its front end and having at its front end a support member extending into the chamber for pivotable disposition in the chamber and having a hitch member at its rear end, a resiliently constrainable member disposed in the chamber on the support member in co-operative relationship with the receptacle for receiving asymmetric forces from the receptacle when the trailer hitch assembly is in a relationship other than a predetermined relationship with the tow trailer, to pivot the support member to a position providing a predetermined relationship between the tow trailer and the trailer hitch assembly.

18. The toy trailer assembly as set forth in claim 17 a first end of the resiliently constrainable member being disposed in co-operative relationship with the receptacle, and a cap disposed in the chamber on the support member for confining of the resiliently constrainable member at a second end of the resiliently constrainable member opposite the first end.

19. The toy trailer assembly as set forth in claim 18 the resiliently constrainable member comprising a helical spring and there being an opening into the chamber through the receptacle and the support member extending from the trailer hitch assembly into the chamber through the opening in the receptacle, and the chamber having a volume to provide for a pivotable movement of the support member in the chamber, and the tow trailer and the trailer hitch assembly having flat beds.

20. The toy trailer assembly as set forth in claim 17 the resiliently constrainable member comprising a helical spring, and the chamber having an opening into the chamber through the receptacle and the support member extending from the trailer hitch assembly into the chamber through the opening in the chamber, and the chamber having a volume to provide for a pivotable movement of the support member in the chamber.

21. The toy trailer assembly as set forth in claim 17 the trailer hitch assembly including an axle support housing, the receptacle and the axle support housing abutting each other over extended surface areas with the trailer hitch assembly and the tow trailer in a predetermined relationship and being disposed in abutment in a line contact at positions relative to the axle for producing forces in cooperation with the axle, with the trailer hitch assembly and the tow trailer to pivot the tow trailer to the predetermined relationship when the trailer hitch assembly and the tow trailer are not in the predetermined relationship.

22. A toy system, comprising:

a tow trailer having an axle and wheels disposed on the axle, a receptacle disposed on the underside of the tow trailer and having an opening, a trailer hitch assembly supported on the axle, a pin disposed on the trailer hitch assembly, the pin having a first end extending through the opening in the and also having first and second opposite sides, a cap disposed on the pin at a second end of the pin opposite the first end of the pin, and a spring disposed on the pin between the cap and the receptacle and operative, upon receiving unequal forces at the first and second opposite sides of the pin, to rotate the trailer hitch assembly to an upright disposition of the pin;

a plurality of vehicles each having an individual address and a hitching member and each constructed to be moved to a position for releasably joining the hitching member of the vehicle to the trailer hitch assembly;

a plurality of pads each manually operable to provide first binary indications for addressing individual ones of the vehicles and second binary indications for providing commands to the individual ones of the vehicles to obtain an operation of such individuals ones of the vehicles in accordance with such commands; and a central station operatively coupled to the pads in the plurality for sending the first and second binary indications from the pads in the plurality to the vehicles in the plurality to address individual ones of such vehicles in accordance with the first binary indications and to obtain an operation of such individual ones of the vehicles in accordance with the second binary indications.

23. The toy system of claim 22 wherein at least one of the plurality of vehicles comprises:

a movable vehicle having an individual address and constructed to be moved to a position for hitching the vehicle to the trailer hitch assembly;

a plurality of manually held pads each manually operable to provide a first plurality of binary indications for addressing the movable vehicle and a second plurality of binary indications for operating the vehicle; and a central station for sending the first and second binary indications from individual ones of the pads to address the vehicle in accordance with the first binary indications and to operate the vehicle in accordance with the second binary indications.

24. The toy system set forth in claim 22 wherein the plurality of movable vehicles each having an individual address and each one of the plurality of vehicles is constructed to be moved to a position for releasably joining the hitching member of the vehicle to the trailer hitch assembly, each of the movable vehicles in the plurality including a motor means operatively coupled to such vehicle for providing a controlled movement of such vehicle, a plurality of manually held pads each manually operable to provide first binary indications for addressing an individual one of the vehicles and second binary indications for providing commands for operating the individual one of the vehicles, and a central station responsive to the first and second binary indications from the pads for sending the binary indications on a cyclic basis to the plurality of vehicles to obtain an operation of the vehicles addressed by the first binary indications from the pads in accordance with the second binary indications from such pads.

* * * * *